US009003678B2

(12) United States Patent
Wan et al.

(10) Patent No.: US 9,003,678 B2
(45) Date of Patent: Apr. 14, 2015

(54) ARTICLE OF FOOTWEAR WITH SUPPORT MEMBERS AND CONNECTING MEMBERS

(75) Inventors: Tee L. Wan, Portland, OR (US); Paul Hooper, Vancouver, WA (US); Nico Tseng, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 795 days.

(21) Appl. No.: 13/226,982

(22) Filed: Sep. 7, 2011

(65) Prior Publication Data

US 2013/0055596 A1 Mar. 7, 2013

(51) Int. Cl.

| | |
|---|---|
| ***A43B 13/14*** | (2006.01) |
| ***A43B 13/12*** | (2006.01) |
| ***A43B 13/18*** | (2006.01) |

(52) U.S. Cl.

CPC ..... *A43B 13/127* (2013.01); *A43B 13/141* (2013.01); *A43B 13/14* (2013.01); *A43B 13/181* (2013.01)

(58) Field of Classification Search

CPC ..... A43B 13/127; A43B 13/16; A43B 13/141
USPC ..... 36/102, 103, 59 R, 30 R, 3 B, 25 R, 31, 36/59 C, 97

See application file for complete search history.

(56) References Cited

U.S. PATENT DOCUMENTS

| | | | | |
|---|---|---|---|---|
| 5,784,808 | A | 7/1998 | Hockerson | |
| 6,990,755 | B2 | 1/2006 | Hatfield et al. | |
| 7,168,190 | B1 | 1/2007 | Gillespie | |
| 7,171,767 | B2 | 2/2007 | Hatfield et al. | |
| 7,290,357 | B2 | 11/2007 | McDonald et al. | |
| 7,392,605 | B2 * | 7/2008 | Hatfield et al. | 36/97 |
| 7,607,241 | B2 | 10/2009 | McDonald et al. | |
| 7,637,035 | B1 | 12/2009 | Gillespie | |
| 7,647,709 | B2 * | 1/2010 | Reilly et al. | 36/30 R |
| 7,946,058 | B2 * | 5/2011 | Johnson et al. | 36/25 R |
| 8,020,320 | B2 | 9/2011 | Gillespie | |
| 2006/0061012 | A1 | 3/2006 | Hatfield et al. | |
| 2008/0060228 | A1 * | 3/2008 | Morgan et al. | 36/103 |
| 2009/0013558 | A1 | 1/2009 | Hazenberg et al. | |
| 2009/0183392 | A1 * | 7/2009 | Shane | 36/97 |
| 2010/0269376 | A1 | 10/2010 | Flannery et al. | |

FOREIGN PATENT DOCUMENTS

WO 2009146231 A1 12/2009

OTHER PUBLICATIONS

International Search Report and Written Opinion, issued Jan. 17, 2013, in the corresponding International Patent Application No. PCT/US2012/053923.

* cited by examiner

*Primary Examiner* — Ted Kavanaugh
(74) *Attorney, Agent, or Firm* — Banner & Witcoff, Ltd.

(57) ABSTRACT

An article of footwear includes an upper and a midsole positioned beneath the upper. The midsole includes an upper portion formed of a first material and a lower portion formed of a second material and positioned beneath the upper portion. The lower portion includes a plurality of support members spaced from adjacent support members. A plurality of connecting members extend between and are connected to adjacent support members, with the connecting members having a height that is less than a height of the support members to which the connecting members are connected, and an upper surface that is substantially flush with an upper surface of the support members to which the connecting members are connected.

19 Claims, 6 Drawing Sheets

ARTICLE OF FOOTWEAR WITH SUPPORT MEMBERS AND CONNECTING MEMBERS

FIELD

Aspects of this invention relate generally to an article of footwear, and, in particular, to an article of footwear having a midsole formed of an upper portion and a lower portion formed of different materials, with the lower portion including a plurality of support members and connecting members extending between the support members, that provides reduced weight, and improved flexibility and support.

BACKGROUND

Conventional articles of athletic footwear generally include two primary elements, an upper and a sole structure. The upper is secured to the sole structure and forms a void on the interior of the footwear for comfortably and securely receiving a foot. The sole structure is secured to a lower portion of the upper and is positioned between the foot and the ground. The sole structure generally incorporates multiple layers that are conventionally referred to as an insole, a midsole, and an outsole. The insole, or sockliner, is a thin, compressible member located within the void and proximate a lower surface of the foot to enhance footwear comfort. The midsole, which is conventionally secured to the upper along the length of the upper, forms a middle layer of the sole structure and is primarily responsible for attenuating ground (or other contact surface) reaction forces to lessen stresses upon the foot and leg. The outsole forms a ground-engaging portion (or other contact surface-engaging portion) of the sole structure, and is formed from a durable and wear-resistant material that includes texturing to improve traction.

The conventional midsole is primarily formed from a resilient, polymer foam material that extends throughout the length of the footwear, often by way of an injection molding process. The properties of the polymer foam material in the midsole are primarily dependent upon factors that include the dimensional configuration of the midsole and the specific characteristics of the material selected for the polymer foam, including the hardness or density of the polymer foam material. By varying these factors throughout the midsole, the relative stiffness and degree of ground reaction force attenuation may be altered to meet the specific demands of the activity for which the footwear is intended to be used. In addition to polymer foam materials, conventional midsoles may include, for example, one or more fluid-filled bladders and moderators.

It would be desirable to provide an article of footwear with a midsole that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

The principles of the invention may be used to provide an article of footwear with a midsole having an upper portion and a lower portion formed of different materials, with the lower portion including a plurality of support members and connecting members extending between the support members, that provides improved flexibility and support.

In accordance with a first aspect, an article of footwear includes an upper and a midsole positioned beneath the upper.

The midsole includes an upper portion formed of a first material and a lower portion formed of a second material and positioned beneath the upper portion. The lower portion includes a plurality of support members spaced from adjacent support members. A plurality of connecting members extend between and are connected to adjacent support members, with the connecting members having a height that is less than a height of the support members to which the connecting members are connected, and an upper surface that is substantially flush with an upper surface of the support members to which the connecting members are connected.

In accordance with another aspect, an article of footwear includes an upper, and a midsole positioned beneath the upper and including an upper portion formed of a first material and having a bottom portion and a first peripheral wall extending upwardly from a periphery of the bottom portion. A lower portion is formed of a second material that has a hardness greater than a hardness of the first material, and is positioned beneath the upper portion. The lower portion includes a plurality of support members spaced from adjacent support members defining gaps between adjacent support members. A plurality of connecting members extend across gaps between and are connected to corresponding adjacent support members, the connecting members having a height that is less than a height of the support members to which the connecting members are connected, and an upper surface that is substantially flush with an upper surface of the support members to which the connecting members are connected. A second peripheral wall extends upwardly from support members positioned along a periphery of the lower portion.

In accordance with yet a further aspect, an article of footwear includes an upper and a midsole positioned beneath the upper. The midsole includes an upper portion formed of a first material and having a bottom portion and a first peripheral wall extending upwardly from a periphery of the bottom portion. A lower portion of the midsole is formed of a second material that has a hardness greater than a hardness of the first material, and is positioned beneath the upper portion. The lower portion includes a plurality of support members spaced from adjacent support members defining gaps between adjacent support members, and a plurality of connecting members extending across gaps between and connected to corresponding adjacent support members. The connecting members have a height that is less than a height of the support members to which the connecting members are connected, and an upper surface that is substantially flush with an upper surface of the support members to which the connecting members are connected. A second peripheral wall extends upwardly from support members positioned along a periphery of the lower portion, with the support members, connecting members and second peripheral wall being of unitary construction. At least one outsole member is secured to a bottom surface of one of the support members.

By providing an article of footwear with a lower portion formed of a material that is firmer than an upper portion, and is formed of support members with connecting members extending between the support members, a user can be provided with improved flexibility as well as improved shock-absorption and support. This is highly advantageous since this can improve the feel and performance of the user's footwear.

These and additional features and advantages disclosed here will be further understood from the following detailed disclosure of certain embodiments.

Figure 1:
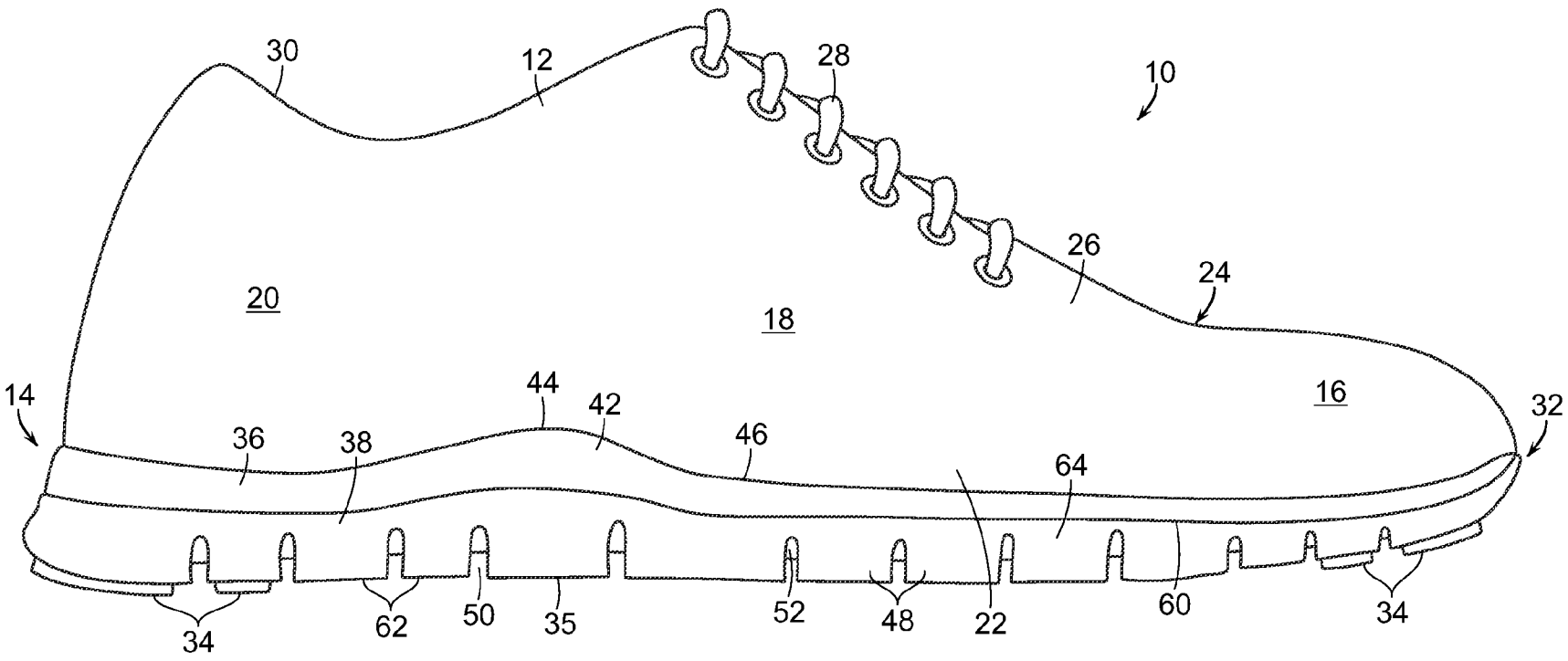
FIG. 1 is an elevation view of an article of footwear with a midsole formed of an upper portion formed of a first material and a lower portion formed of a second material.

The figures referred to above are not drawn necessarily to scale, should be understood to provide a representation of particular embodiments of the invention, and are merely conceptual in nature and illustrative of the principles involved. Some features of the article of footwear with a midsole formed of an upper portion and a lower portion have been enlarged or distorted relative to others to facilitate explanation and understanding. The same reference numbers are used in the drawings for similar or identical components and features shown in various alternative embodiments. Footwear as disclosed herein would have configurations and components determined, in part, by the intended application and environment in which they are used.

DETAILED DESCRIPTION OF CERTAIN PREFERRED EMBODIMENTS

An article of footwear 10 is depicted in FIG. 1 as including an upper 12 and a sole assembly 14. Article of footwear 10 can be any of various articles of casual footwear having configurations suitable, for example, for walking or lounging. Footwear 10 may also be one of a wide range of athletic footwear styles, including shoes that are suitable for soccer, running, basketball, baseball, cross-training, football, rugby, tennis, and volleyball, for example. An individual skilled in the relevant art will appreciate, therefore, that the concepts disclosed herein with regard to footwear 10 may be applied to a wide variety of footwear styles, in addition to the specific styles discussed herein and depicted in the accompanying figures.

For purposes of reference in the following description, footwear 10 may be divided into three general regions: a forefoot region 16, a midfoot region 18, and a heel region 20. Regions 16-20 are not intended to demarcate precise areas of footwear 10. Rather, regions 16-20 are intended to represent general areas of footwear 10 that provide a frame of reference during the following discussion. Although regions 16-20 apply generally to footwear 10, references to regions 16-20 also may apply specifically to upper 12, sole assembly 14, or individual components within either upper 12 or sole assembly 14.

Upper 12 defines a void or chamber for receiving a foot. For purposes of reference, upper 12 includes a medial side 22, an opposite lateral side 24, and a vamp or instep area 26. Lateral side 24 is positioned to extend along a lateral side of the foot (i.e., the outside) and generally passes through each of regions 16-20. Similarly, medial side 22 is positioned to extend along an opposite medial side of the foot (i.e., the inside) and generally passes through each of regions 16-20. Upper 12 may also include a closure mechanism, such as lace 28. Upper 12 also includes an ankle opening 30 that provides the foot with access to the void within upper 12.

Sole assembly 14 includes a midsole 32 positioned below upper 12. Midsole 32 serves to provide shock-attenuation and energy-absorption for footwear 10. In certain embodiments, midsole 32 is secured to upper 12. Midsole 32 may be secured to upper 12 with an adhesive, for example. Suitable adhesives are well known in the art and need not be discussed in greater detail here. Midsole 32 may be secured to upper 12 with any other suitable fastening means including, for example, stitching, or stitching and adhesive. Other suitable means of fastening midsole 32 to upper 12 will become readily apparent to those skilled in the art, given the benefit of this disclosure.

Suitable materials for midsole 32 include any of the conventional polymer foams that are utilized in footwear midsoles, including ethylvinylacetate (EVA) and polyurethane foam. Other suitable materials for midsole 32 will become readily apparent to those skilled in the art, given the benefit of this disclosure.

An outsole 34 may be positioned below midsole 32. In certain embodiments, outsole 34 is secured to midsole 32. Outsole 34 may be secured to midsole 32 and/or upper 12 with an adhesive, for example. Suitable adhesives are well known in the art and need not be discussed in greater detail here. Outsole 34 may be secured to midsole 32 with any other suitable fastening means including, for example, stitching, or stitching and adhesive. Other suitable means of fastening outsole 34 to midsole 32 and/or upper 12 will become readily apparent to those skilled in the art, given the benefit of this disclosure.

In certain embodiments, outsole 34 may be formed of a layer of material secured to and extending over a portion of the bottom surface of midsole 32. In other embodiments, outsole 34 may be formed of a plurality of individual outsole members 33 secured to the bottom surface of midsole 32. Suitable materials for outsole 34 include any of the conventional rubber materials that are utilized in footwear outsoles, such as carbon black rubber compound. Other suitable materials for outsole 34 will become readily apparent to those skilled in the art, given the benefit of this disclosure.

Figure 4:
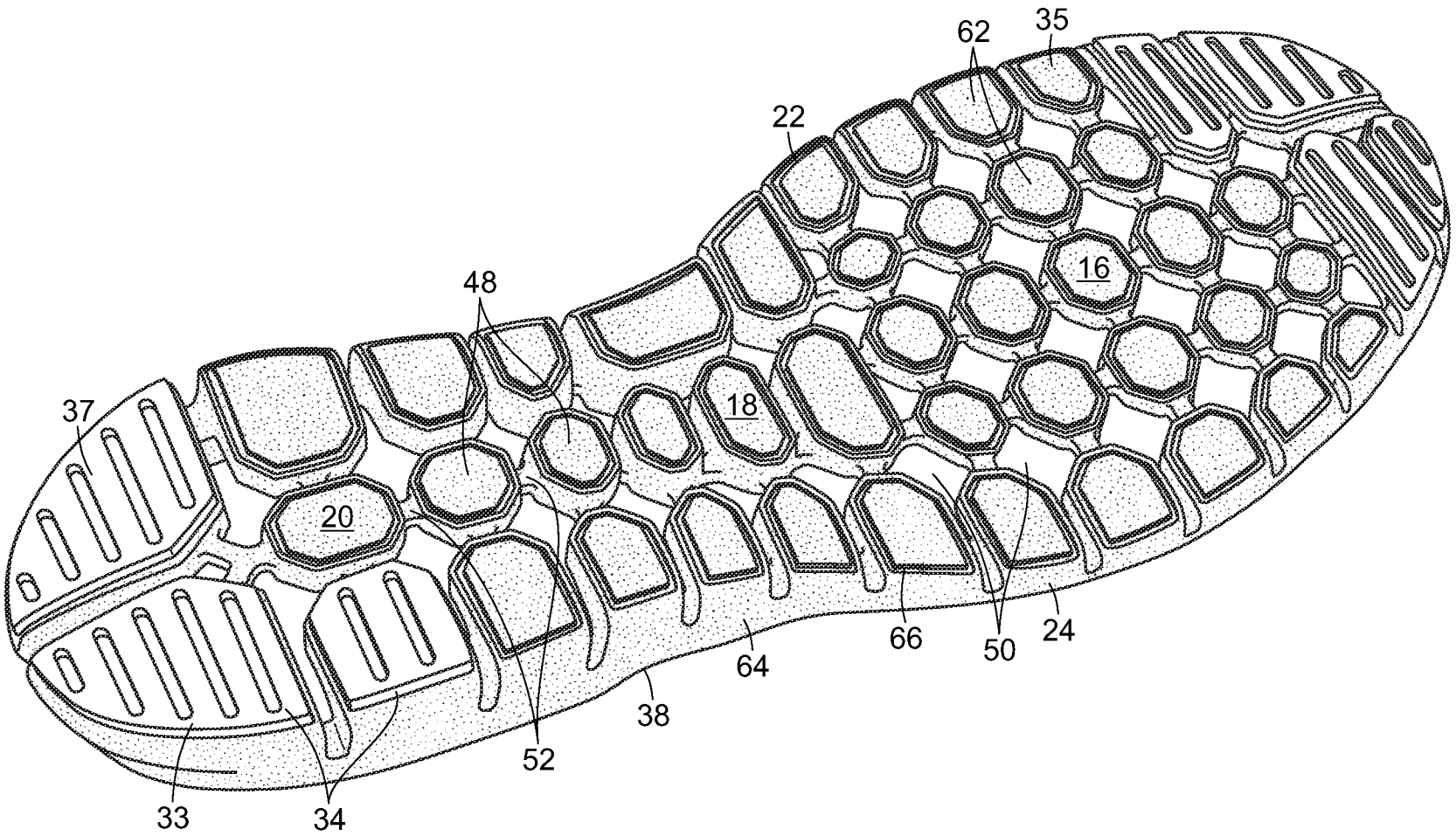
FIG. 4 is a perspective view of the lower portion of the midsole of FIG. 1, shown in an inverted condition.

As can be seen in FIG. 4, the bottom surface of outsole members 33 may include grooves or recesses 37 formed therein. It is to be appreciated that recesses 37 may have any desired shape. As illustrated here, the recesses are longitudinal and extend transversely across of midsole 32.

In other embodiments, rather than include a separate outsole, the bottom surface 35 of midsole 32 may form the ground-contacting surface of footwear 10.

Midsole 32 includes an upper portion 36 positioned beneath upper 12 formed of a first material of a first hardness, and a lower portion 38 positioned beneath upper portion 36 and formed of a second material having a second hardness that is greater than the first hardness. Thus, lower portion 38 is firmer than upper portion 36, and provides for more of the shock-attenuation and energy-absorption aspects of midsole 32.

While the thickness of midsole 32 varies throughout the forefoot, midsole and heel portions in order to provide different shock-attenuation and energy-absorption levels for the user's foot in different areas, the relative thicknesses of upper portion 36 and lower portion 38 may also vary throughout midsole 32 in order to provide different shock-attenuation and energy-absorption levels.

Figure 2:
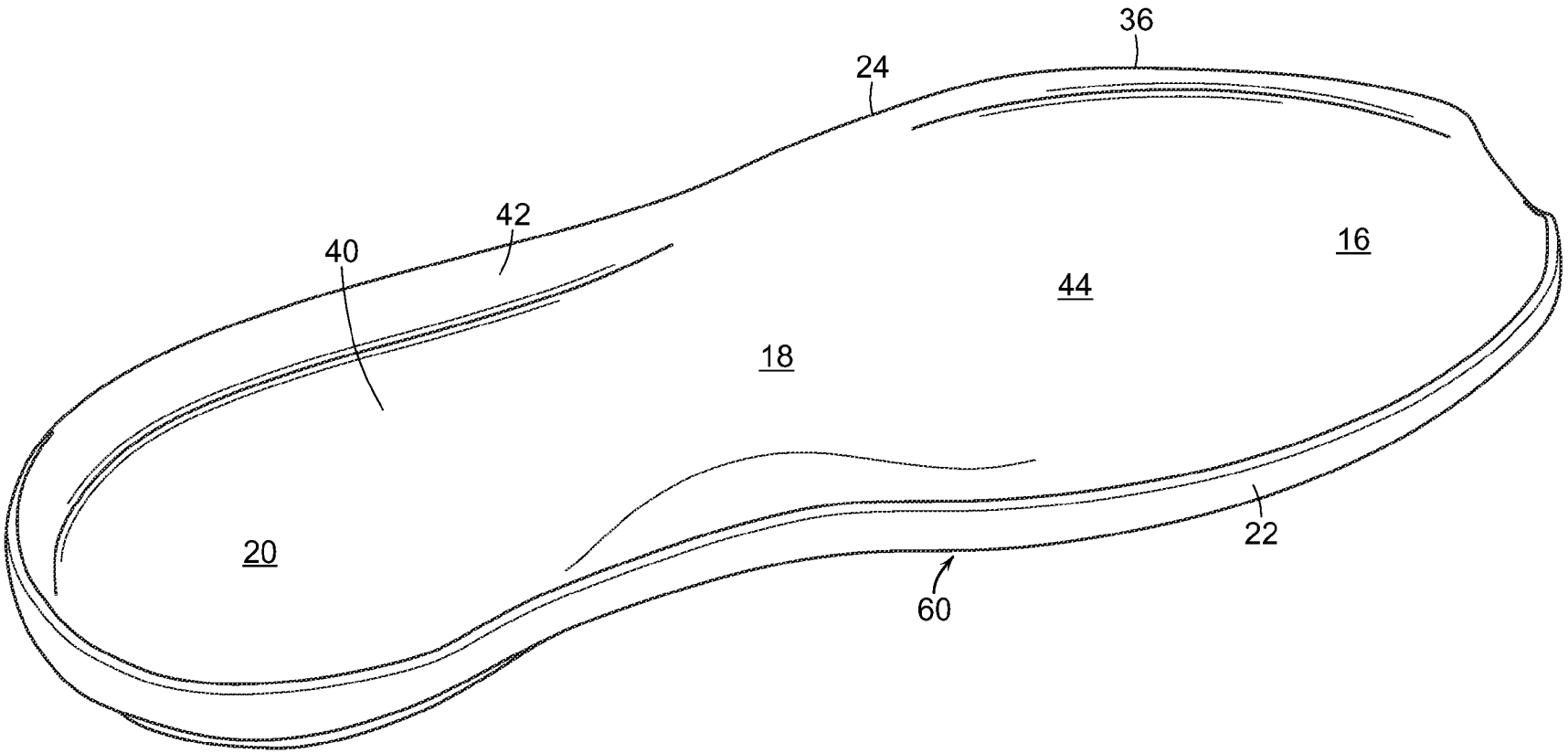
FIG. 2 is a perspective view of the upper portion of the midsole of FIG. 1.

As seen in FIG. 2, upper portion 36 includes a bottom portion 40 and a first peripheral wall 42 extending upwardly from a periphery of bottom portion 40. The upper surface 44 of upper portion 32 is secured to the bottom surface 46 of upper 12. As noted above, upper portion may be secured to upper 12 with an adhesive or other suitable fastening means.

In certain embodiments, the first material that forms upper portion is foam ethylene vinyl acetate (EVA), often referred to as injection molded Phylon. Phylon may be made of EVA foam pellets, slabs, or sheets that are compressed, heated and expanded, and then cooled.

Although, as noted above, the first material and second material may both be formed of EVA, or PU, they have different properties such that first material has a lower resiliency than that of the second material. Providing the first and second materials with different hardness, resiliency, stiffness, and other parameters, allows upper portion 36 and lower portion 38 of midsole 32 to be customized or optimized to provide particular performance characteristics.

In certain embodiments the first material has a hardness of approximately 48 Asker C, and the second material has a hardness of approximately 55 Asker C.

Figure 3:
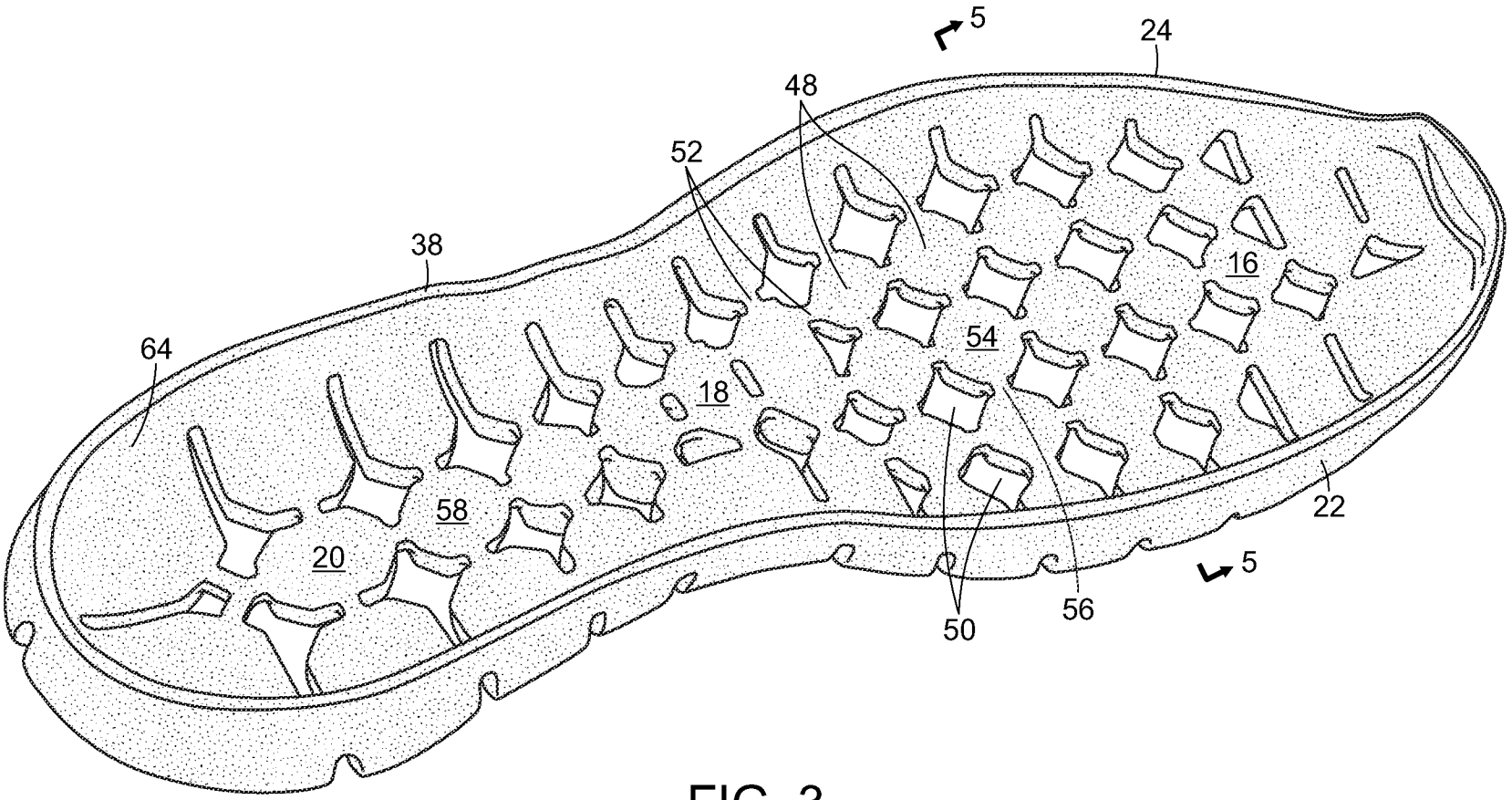
FIG. 3 is a perspective view of the lower portion of the midsole of FIG. 1.
Figure 5:
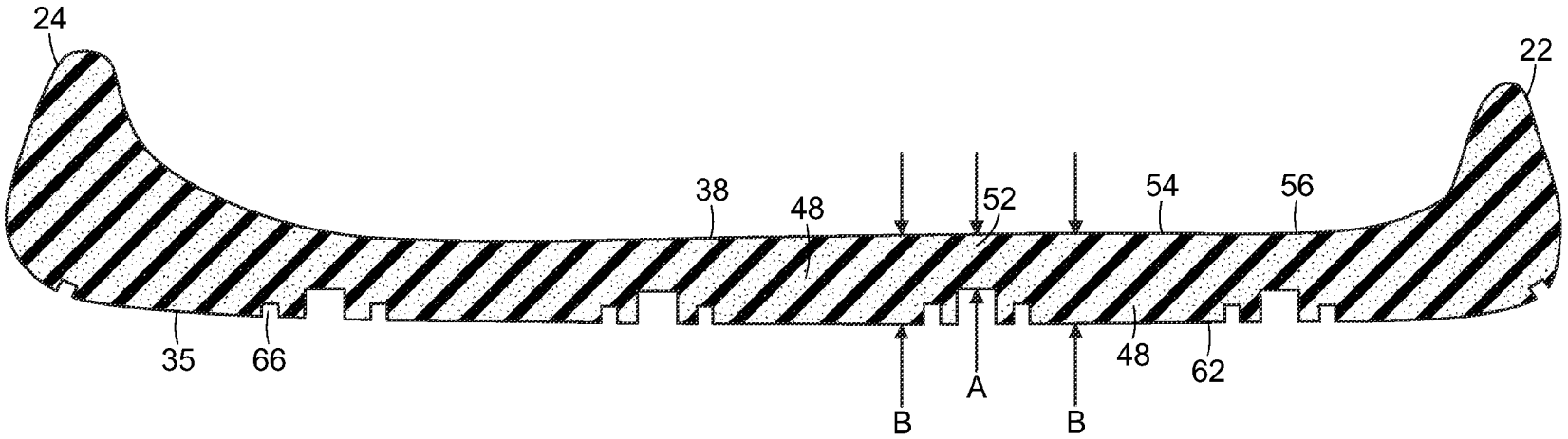
FIG. 5 is a section view of the lower portion of FIG. 3, taken along lines 5-5 of FIG. 3.

As seen in FIGS. 3-5, lower portion 38 is positioned below upper portion 36 and includes a plurality of support members 48 spaced from one another with gaps 50 formed therebetween. A plurality of connecting members 52 extend between and are connected to adjacent support members 48. The top or upper surfaces 54 of support members 48 and upper surfaces 56 of connecting members 52 cooperate to define an upper surface 58 of lower portion 38 to which a bottom surface 60 of upper portion 36 is secured.

As can be seen best in FIG. 5, the upper surface 56 of each connecting member 52 is substantially flush with the upper surfaces 54 of the support members 48 to which that connecting member 52 is connected.

Bottom surfaces 62 of all of the support members 48 combine to form bottom surface 35 of midsole 32. In certain embodiments, as illustrated in FIG. 4, outsole 34 is formed of outsole members 33 secured to bottom surface 35 of midsole 32. In the illustrated embodiment, outsole members 33 are secured to support members 48 in the heel portion 16 and forefoot portion 20 of midsole 32, where high wear is experienced. It is to be appreciated that any number of outsole members 33 may be secured to midsole 32 at any desired locations. In the illustrated embodiment, a second peripheral wall 64 extends upwardly from support members 48 positioned along a periphery of the lower portion.

In certain embodiments, connecting members 52 have a height that is less than a height of the support members 48 to which the connecting members are connected. This is illustrated in FIG. 5, in which it can be seen that one of the connecting members 52 has a height, or thickness, A, that is less than a height, or thickness, B of the support members 48 to which it is connected.

In certain embodiments, at least one of the connecting members 52 has a height A that is approximately 3 mm and a width of approximately 4 mm. In other embodiments, at least one of the connecting members 52 may have a height A of approximately 4 mm. In other embodiments, a width of at least one of the connecting members 52 can be as wide as approximately 10 mm.

In certain embodiments, as seen in FIGS. 4-5, bottom surfaces 62 of support members 48 may include one or more grooves or recesses 66. In the illustrated embodiments, recesses 66 extend about the periphery of the bottom surface 62 of support members 48. In the embodiment illustrated in FIG. 6, recesses 66 form an X-shape in the bottom surface of a plurality of support members 48.

It is to be appreciated that support members 48 may have any desired shape. In the embodiment illustrated in FIGS. 3 and 4, a plurality of support members 48 that are positioned throughout the central area of forefoot portion 16, midfoot portion 18, and heel portion 20 that have an octagon shape. Other support members 48 about the periphery of lower portion 38 are substantially rectangular with inner ends thereof having beveled, or truncated corners.

Figure 6:
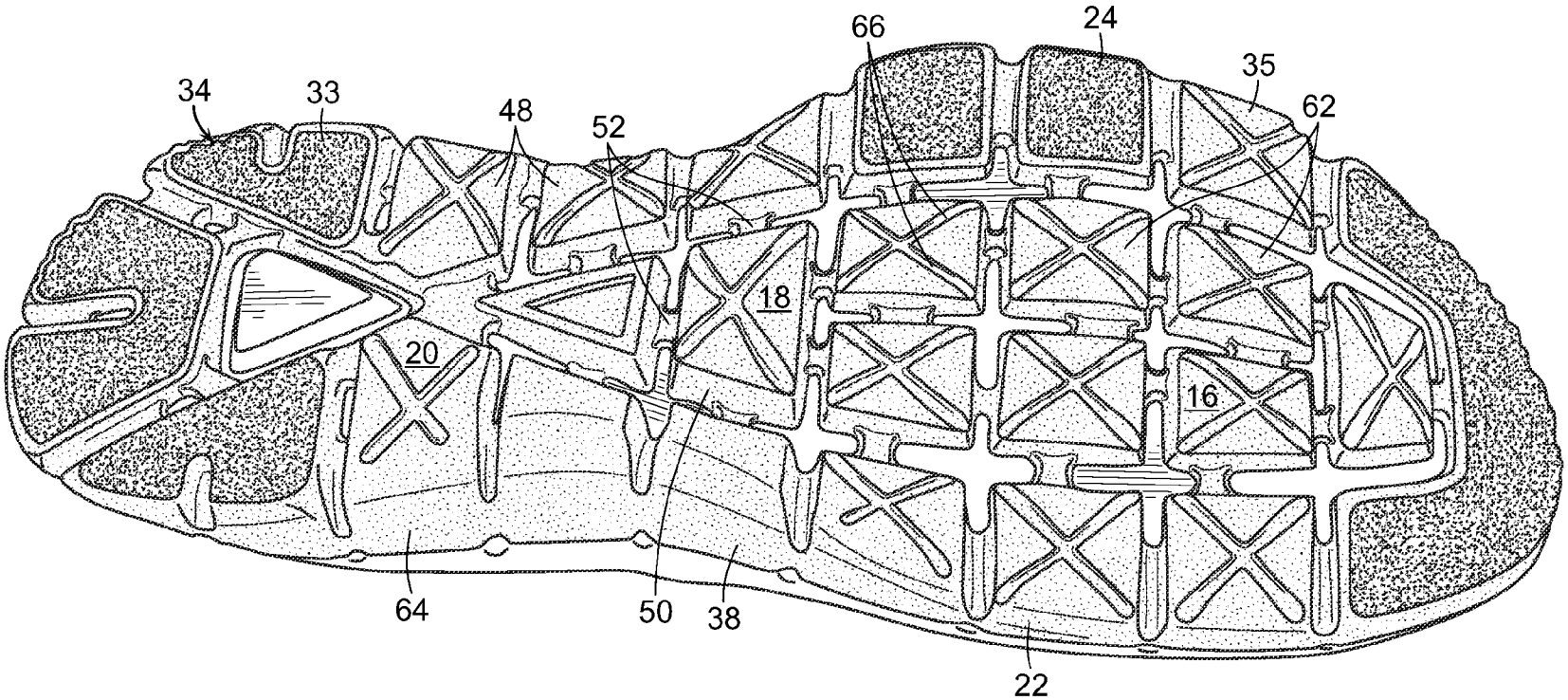
FIG. 6 is a perspective view of an alternative embodiment of the lower portion of the midsole of FIG. 1, shown in an inverted condition.

In the embodiment illustrated in FIG. 6, a support member 48 in each of heel portion 20 and midfoot portion 18 have a triangular shape. Thus, it can be seen that support members 48 can have any desired shape.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. An article of footwear comprising:
an upper; and
a midsole positioned beneath the upper and comprising:
an upper portion formed of a first material; and
a lower portion formed of a second material, positioned beneath the upper portion, and comprising:
a plurality of support members spaced from adjacent support members defining gaps between adjacent support members that extend completely through the lower portion, with each gap being spaced from a periphery of the lower portion and completely surrounded by a peripheral wall formed of the second material; and
a plurality of connecting members extending between and connected to adjacent support members, the connecting members having a height that is less than a height of the support members to which the connecting members are connected, and an upper surface that is substantially flush with an upper surface of the support members to which the connecting members are connected.

2. The article of footwear of claim 1, wherein the upper portion includes a bottom portion and a peripheral wall extending upwardly from a periphery of the bottom portion.

3. The article of footwear of claim 1, further comprising a peripheral wall extending upwardly from support members positioned along a periphery of the lower portion.

4. The article of footwear of claim 3, wherein the peripheral wall is of unitary construction with the support members.

5. The article of footwear of claim 1, wherein the support members and the connecting members are of unitary construction.

6. The article of footwear of claim 1, wherein the second material has a hardness greater than a hardness of the first material.

7. The article of footwear of claim 1, wherein the second material has a density greater than a density of the first material.

8. The article of footwear of claim 1, wherein the second material has a resistance to abrasion greater than a resistance to abrasion of the first material.

9. The article of footwear of claim 1, wherein the first material is EVA.

10. The article of footwear of claim 1, wherein the second material is EVA.

11. The article of footwear of claim 1, wherein an upper surface of the support members and an upper surface of the connecting members define an upper surface of the lower portion to which a bottom surface of the upper portion is secured.

12. The article of footwear of claim 1, further comprising a plurality of outsole members secured to a bottom surface of the lower portion.

13. The article of footwear of claim 12, wherein the outsole members are secured to bottom surfaces of the support members.

14. An article of footwear comprising:

an upper; and a midsole positioned beneath the upper and comprising:

an upper portion formed of a first material and having a bottom portion and a first peripheral wall extending upwardly from a periphery of the bottom portion; and a lower portion formed of a second material that has a hardness greater than a hardness of the first material, positioned beneath and in contact with the upper portion; and comprising:

a plurality of support members spaced from adjacent support members defining gaps between adjacent support members that extend completely through the lower portion, with each gap being spaced from a periphery of the lower portion and completely surrounded by a peripheral wall formed of the second material;

a plurality of connecting members extending across the gaps between, and connected to, corresponding adjacent support members, the connecting members having a height that is less than a height of the support members to which the connecting members are connected, and an upper surface that is substantially flush with an upper surface of the support members to which the connecting members are connected; and a second peripheral wall extending upwardly from support members positioned along a periphery of the lower portion.

15. The article of footwear of claim 14, wherein the support members and the connecting members are of unitary construction.

16. The article of footwear of claim 14, wherein each of the first and second material is EVA.

17. The article of footwear of claim 14, wherein an upper surface of the support members and an upper surface of the connecting members define an upper surface of the lower portion to which a bottom surface of the upper portion is secured.

18. The article of footwear of claim 14, further comprising at least one outsole member secured to a bottom surface of at least one of the support members.

19. An article of footwear comprising:

an upper;

a midsole positioned beneath the upper and comprising:

an upper portion formed of a first material and having a bottom portion and a first peripheral wall extending upwardly from a periphery of the bottom portion; and a lower portion formed of a second material that has a hardness greater than a hardness of the first material, positioned beneath the upper portion; and comprising:

a plurality of support members spaced from adjacent support members defining gaps between adjacent support members that extend completely through the lower portion, with each gap being spaced from a periphery of the lower portion and completely surrounded by a peripheral wall formed of the second material;

a plurality of connecting members extending across the gaps between, and connected to, corresponding adjacent support members, the connecting members having a height that is less than a height of the support members to which the connecting members are connected, and an upper surface that is substantially flush with an upper surface of the support members to which the connecting members are connected; and a second peripheral wall extending upwardly from support members positioned along a periphery of the lower portion, the support members, connecting members and second peripheral wall being of unitary construction; and at least one outsole member, each outsole member secured to a bottom surface of one of the support members.

* * * * *